United States Patent [19]

Nagati

[11] 4,436,291

[45] Mar. 13, 1984

[54] METALLURGICAL VESSEL SUSPENSION SYSTEM

[75] Inventor: Rashed N. Nagati, Mars, Pa.

[73] Assignee: Pennsylvania Engineering Corporation, Pittsburgh, Pa.

[21] Appl. No.: 340,316

[22] Filed: Jan. 18, 1982

[51] Int. Cl.[3] ..... C21C 5/50

[52] U.S. Cl. ..... 266/246; 266/245

[58] Field of Search ..... 266/246, 247, 45, 245; 75/60

[56] References Cited

U.S. PATENT DOCUMENTS 4,275,871 6/1981 Nagati ..... 266/246

4,281,823 8/1981 Enkner ..... 266/246

*Primary Examiner*—L. Dewayne Rutledge

*Assistant Examiner*—S. Kastler

*Attorney, Agent, or Firm*—Fred Wiviott

[57] ABSTRACT

A molten metal processing vessel is supported on a trunnion support by a plurality of upper and lower link members each having a pair of legs. One pair of link member legs are coupled to and are disposed between three hinge members affixed to the vessel. The other legs of the upper members are also pivotally connected to and disposed between three hinge members mounted atop the trunnion support and the other legs of the lower members are pivotally connected to and disposed between three hinge members mounted on an auxiliary ring disposed adjacent the lower end of the trunnion support. The gap between the legs which are coupled to the vessel is greater than those coupled to the trunnion support. The trunnion support includes a plurality of spring washers disposed between an auxiliary ring and a trunnion and are prestressed by a spring seat and tapered spring adjustment members.

5 Claims, 4 Drawing Figures

METALLURGICAL VESSEL SUSPENSION SYSTEM

BACKGROUND OF THE INVENTION

This invention relates to molten metal processing vessels and more particularly a linkage assembly for mounting such vessels on trunnion rings.

One type of vessel for converting molten ferrous metal to steel includes means such as tuyeres or lances for introding air or oxygen into the metal whereby components such as carbon may be oxidized. The heat generated during these exothermic reactions causes differential expansion between the vessel and the water cooled trunnion ring on which such vessels are normally mounted. As a result, there has been numerous prior art attempts to pivoting links between the vessel and trunnion ring which provide adequate support and to permit the vessel to expand to a greater degree than the ring. While some of these prior art support systems were an improvement over previous supports, they were prone to relatively rapid wear and consequent loss of stability unless replaced.

SUMMARY OF THE INVENTION

It is an object of the invention to provide a new and improved support for pneumatic metallurgical vessels.

A further object of the invention to provide a metallurgical vessel suspension system which supports the vessel in vertical and tilted positions and permits differential expansion between the vessel and a surrounding trunnion ring.

Another object of the invention is to provide a converter vessel suspension system wherein mechanical load is relatively uniformly distributed around the trunnion ring.

A still further object of the invention is to provide a support for converter vessels which does not restrict axial vessel expansion.

Yet another object of the invention is to provide a linkage assembly for mounting a vessel on a trunnion ring and which is stable and not prone to inordinate wear.

These and other objects and advantages of the invention will become more apparent from the detailed description thereof taken with the accompanying drawings.

In general terms, the invention comprises a metallurgical vessel subject to expansion and contraction during its operating cycles and including trunnion support means at least partially surrounding the vessel and a plurality of members, each having a pair of spaced-apart legs extending longitudinally from each end. The legs of each member are respectively pivotally mounted to a first group of hinge members on the vessel and a second group of hinge members mounted on the trunnion support. Each group of hinge members includes a first hinge member disposed between the legs of its pivotally connected member and the second and third hinge members disposed adjacent the opposite sides thereof. The gap between the legs coupled to the vessel and the width of the hinge member disposed therebetween is greater than the gap between the legs and the hinge member at the trunnion support end of each member. According to a more specific aspect of the invention, the trunnion support includes a trunnion ring and an auxiliary ring disposed adjacent the lower end of the trunnion ring. There are also a plurality of spring washers disposed between the auxiliary ring and the trunnion ring. The washers are stressed by a spring seat and tapered spring adjustment members.

BRIEF DESCRIPTION OF THE INVENTION

DESCRIPTION OF THE PREFERRED EMBODIMENTS

Figure 1:
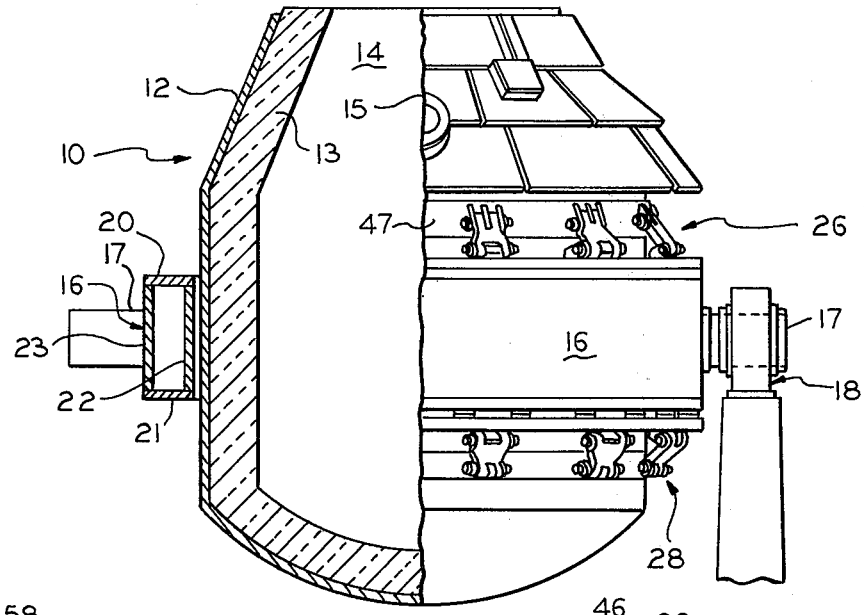
FIG. 1 is a side elevational view with parts broken away of a converter vessel having a suspension system according to the present invention.

FIG. 1 shows a converter vessel 10 which is one example of a metallurgical vessel to which the suspension system according to the present invention is applicable. As those skilled in the art will appreciate, however, the suspension system is applicable to any metallurgical vessel which is supported within a so-called trunnion ring. The vessel 10 is shown to include a metallic shell 12 and a refractory lining 13. A top opening 14 permits charging of the vessel with hot metal or scrap. The vessel 10 may also have a pouring spout 15 which permits the discharge of its contents into a ladle or other suitable receptacle when the vessel is tipped.

As seen in FIG. 1, the vessel 10 is sourrounded by a concentric trunnion ring 16. Extending from each of the diametrically operative sides of trunnion ring 16 are a pair of coaxial trunnion pins 17, only one of which is seen in FIG. 1. Pins 17 are usually journaled in suitable supports 18 and are coupled to a suitable drive mechanism (not shown) which provides the requisite torque for tilting the trunnion ring 16 and the vessel 10 which it supports. The trunnion pins 17 may also be hollow so as to allow the entry and exit of cooling water to the interior of trunnion ring 16. In the illustrated examples, the interior of trunnion ring 16 is intended to be water-cooled but the specific details of construction are omitted since they are well-known in the art and form no part of the present invention.

Figure 2:
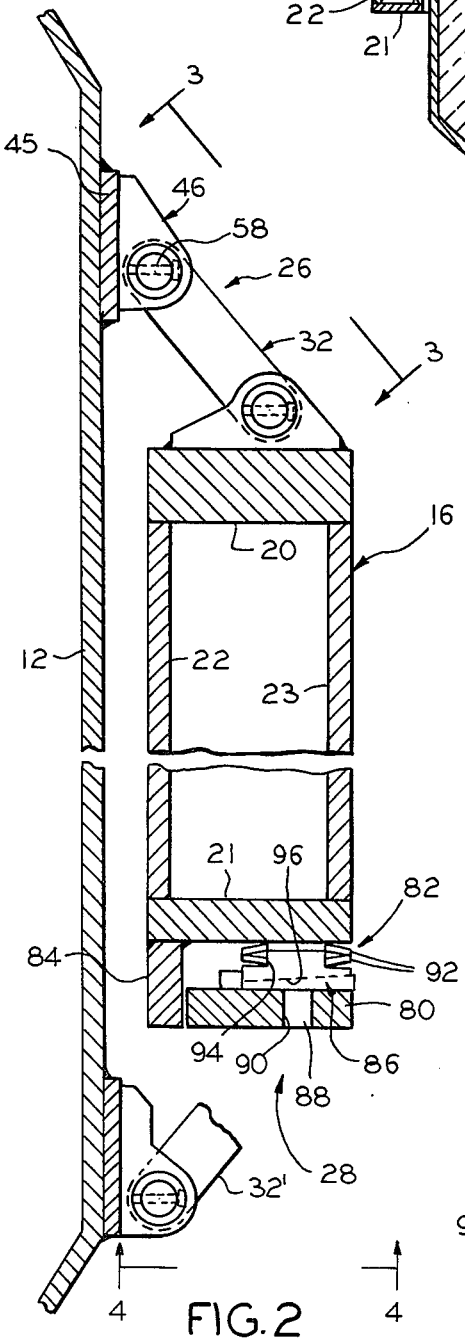
FIG. 2 is a cross-sectional view showing a portion of the suspension system of FIG. 1 in greater detail.

Trunnion ring 16 is shown in FIGS. 1 and 2 to include a top ring-like flange 20 and a similar bottom flange 21 which is spaced from top flange 20 and is arranged in a generally concentric parallel relation with respect thereto. The flanges 20 and 21 are joined at their edges by an annular inner wrapper plate 22 and an annular outer wrapper plate 23 which is concentric with wrapper plate 22 and spaced therefrom in a generally parallel relation. The joints between flanges 20 and 21 and wrapper plates 22 and 23 may be secured in any suitable manner such as by welding. It will also be appreciated that trunnion ring 16 in the illustrated example is essentially a hollow, circular box girder. While not shown in the drawings, trunnion ring 16 may also be reinforced internally by a series of circumferentially spaced radially disposed plates each of which has an aperture to permit the circulation of cooling water if desired. It will also be apparent that the vessel suspension system according to the present invention is applicable whether the trunnion ring 16 has a configuration illustrated in FIGS. 1 and 2 or is in another form such as an I-beam, channel or various other cross-sectional shapes.

As seen more particularly in FIG. 2, the vessel 10 is supported on the trunnion ring 16 by an upper suspension assembly 26 and a lower suspension assembly 28. The upper suspension assembly 26 includes a plurality of links 32 which are pivotally connected at their lower ends to the upper flange 20 of trunnion ring 16 and at their upper ends to the vessel 12.

Figure 3:
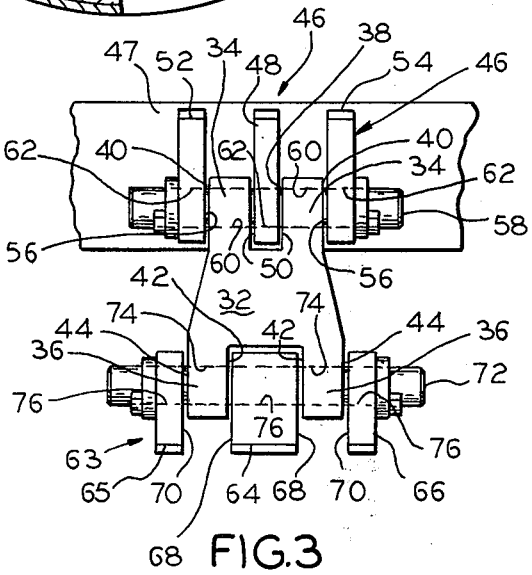
FIG. 3 is a view taken along lines 3—3 of FIG. 2.

Each link 32 is shown in FIG. 3 to include pairs of legs 34 and 36 extending in longitudinal parallel spaced apart relation from the upper and lower ends respectively to define parallel spaced apart surfaces 38 and 40 on the inner and outer faces of legs 34 and 42 and 44 on the inner and outer faces of legs 36. The arms 34 of each link 32 are pivotally connected to vessel 10 by a first hinge assembly 46 mounted on a ring 48 affixed circumferentially to the shell 12 of vessel 10. The hinge assembly 46 includes a first hinge element 48 disposed between legs 34 and having outer surfaces 50 parallel to and adjacent the surfaces 38 and second and third hinge members 52 and 54 having inner surfaces 56 parallel to and adjacent surfaces 40. In addition, a pin 58 extends through aligned openings 60 in legs 34 and 62 in hinge members 48, 52 and 54, whereby member 32 is pivotally connected at one end to the vessel.

In a similar manner, legs 36 are pivotally connected to trunnion ring 16 by a second hinge assembly 63 comprising hinge members 64, 65 and 66 mounted on trunnion ring flange 20 in parallel spaced-apart relation with member 64 having outer surfaces 68 parallel to and adjacent the inner surfaces 42 of legs 36 and hinge members 66 have inner surfaces 70 parallel to and adjacent the outer surfaces 44 of said legs. Pin 72 extending through aligned opening 74 in legs 36 and 76 in hinge members 64, 65 and 66 to pivotally couple the member 32 to the trunnion ring 16. It can be seen, therefore, that the pivotal connection the upper and lower ends of the links 32 are identical except that the gap between the legs 36 is greater than that between the legs 34 and further the member 64 is wider than the member 48.

The lower support assembly 28 includes link members 32' which are pivotally connected at their lower end to the vessel 10 by a first hinge assembly 46' and at its upper end by a second hinge assembly 63' to an auxiliary ring 80 disposed adjacent to and spaced from the lower trunnion ring flange 21. The link members 32' are identical to the link members 32 as are the hinge assemblies 46' and 63' identical to the hinge assemblies 46' and 47. Accordingly, the link members 32' and the hinge assemblies 46' and 63' will not be discussed in detail for the sake of brevity. However, like portions of these members have been provided with the same reference numeral as those employed with regard to the upper support assembly except that the lower members are distinguished by a prime (').. It will be noted, however, that the link members 32' are inverted relative to the link members 32' in that the lower legs 36' are spaced-apart a greater distance than the legs 34' and the hinge member 64' is wider than the hinge member 48'. Ring 80 is disposed in spaced relation relative to the lower trunnion ring flange 20 and there is a plurality of spring assemblies 82 disposed therebetween. A flange ring 84 is affixed to the inner edge of the lower trunnion ring flange 21 to minimize radial movement of ring 80 relative to the vessel 10 and trunnion ring 16.

Figure 4:
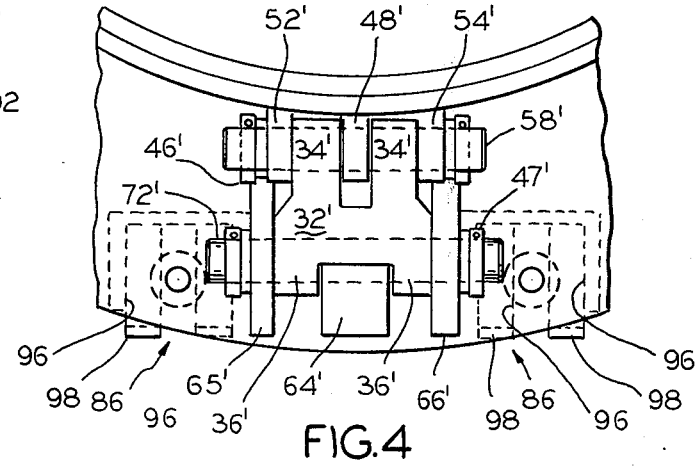
FIG. 4 is a view taken along the lines 4—4 of FIG. 2 with parts broken away.

Each spring assembly 82 includes an annular spring seat 86 having a downwardly extending locating stud 88 which is received in an opening 90 formed in ring 80. A pair of annular spring washers 92 are received on a reduced diameter section at the upper end of seat 86 and the upper spring 92 bears against the underside of trunnion flange 21. A pair of tapered groves 96 are formed in the lower surface of the spring seat 92 and extends generally parallel to the longitudinal axis of link 32'. A wedge 98 is disposed in each group 96 for forcing the seat 86 toward the flange 21 and thereby stressing the spring washers 92. Preferable, a pair of spring assemblies 82 are disposed on each side of each link 32' as shown in FIG. 4.

While only a single embodiment of the invention has been illustrated and described, it is not intended to be limited thereby but only by the scope of the appended claims.

I claim:

1. A metallurgical vessel subject to expansion and contraction during its operating cycles and including trunnion support means having a support surface at least partially surrounding the vessel and a plurality of link members each having a first pair of spaced apart legs extending longitudinally from one end and a second pair of spaced apart legs extending from the opposite end, an auxiliary support, the first and second pairs of legs of each member are respectively pivotally coupled to a first hinge means mounted on the vessel and a second hinge means mounted on the auxiliary support, each hinge means including a first hinge member disposed between the legs of its pivotally connected link member and second and third hinge members disposed adjacent the opposite sides thereof, and first and second pin means extending respectively through said first and second pairs of legs and the hinge members associated therewith, said pin means extending generally tangentially relative to said vessel, the gap between the legs of the pair which is coupled to the vessel and the width of the hinge member disposed therebetween is less than the gap between the legs and of the pair which is coupled to the auxiliary support and the width of the hinge member disposed therebetween, said auxiliary support having a surface substantially coextensive with and disposed in an opposed relation to said support surface, and resilient means being disposed between said surfaces.

2. The vessel set forth in claim 1 wherein the trunnion support includes a trunnion ring, the auxiliary support comprising an auxiliary ring disposed adjacent the lower end of the trunnion ring, said resilient means comprising a plurality of spring means mounted in spaced relation on the auxiliary ring, biasing means for forcing said spring means against said trunnion means to provide a resilient coupling between said auxiliary ring and said trunnion support, a portion of the plurality of said link members being pivotally connected to said vessel and said auxiliary ring on the side of said ring opposite to said spring means.

3. The vessel set forth in claim 2 wherein each said spring means includes a spring seat adjacent said auxiliary ring and a plurality of spring members disposed between said spring seat and said trunnion support, said biasing means comprising wedge means disposed between said spring seat and said ring.

4. The vessel set forth in claims 1, 2 or 3 wherein the legs of each pair of legs has a pair of side surfaces formed thereon, said hinge members each having complimentary surfaces disposed adjacent said side surfaces.

5. A metallurgical vessel subject to expansion and contraction during its operating cycles, trunnion support means at least partially surrounding the vessel and suspension means for securing the vessel to the trunnion support whereby said vesssel will be tilted when the trunnion support is tilted, said suspension means including:

first and second groups of link members, each link member having a pair of spaced-apart legs extending longitudinally from one end and a second pair of spaced-apart legs extending from the opposite end, first, second, third and fourth groups of hinge means, the hinge means of said first and second groups being mounted in spaced-apart relation around the periphery of the vessel and respectively above and below said trunnion support, the hinge means of said third and fourth groups being mounted in spaced-apart relation around said trunnion support and respectively adjacent the upper and lower portions thereof and each being in an opposed relation to one of the hinge means of said first or second groups, the first and second pair of legs of the link members of the first group being respectively pivotally coupled to one of the hinge means of the first and third groups of hinge means and the first and second pair of legs of the second group of link members being respectively pivotally connected to one of the hinge means of said second and fourth groups of hinge means, each hinge means of the first, second, third and fourth groups of hinge means including a first hinge member disposed between the legs of its pivotally connected link member and substantially filling the gap therebetween, and second and third hinge members disposed closely adjacent the opposite sides thereof, first and second pin means extending respectively through the first and second pair of legs and the hinge members associated therewith, said pin means extending generally tangent relative to said vessel, the gap between the legs of the pair which is coupled to said vessel and the width of the hinge member disposed therebetween is smaller than the gap between the legs of the pair which is coupled to the trunnion support and the width of the hinge member disposed therebetween, whereby said link members on the opposite sides of said trunnion support mutually support said vessel and said link and hinge members resist torsional forces tangent to the surface of said vessel, said trunnion support including a trunnion ring having a support surface, an auxiliary member having a surface substantially coextensive with and disposed in an opposed relation to said support surface, said third group of hinge members being mounted on said auxiliary member, and resilient means disposed between said support surface and the surface on said auxiliary member.

* * * * *